US005095430A

United States Patent [19]

Bonito et al.

[11] Patent Number: 5,095,430

[45] Date of Patent: Mar. 10, 1992

[54] GOLF CART COMPUTER WITH CARTRIDGE STORAGE

[75] Inventors: Anthony P. Bonito, North Lauderdale; Craig G. Kallen, Fort Lauderdale; Brett E. Price, Plantation; Michael R. Appleton, Lauderdale Lakes, all of Fla.

[73] Assignee: Joseph W. Remedio, Boca Raton, Fla.

[21] Appl. No.: 511,960

[22] Filed: Apr. 17, 1990

Related U.S. Application Data

[63] Continuation of Ser. No. 300,227, Jan. 23, 1989, abandoned, which is a continuation of Ser. No. 14,027, Feb. 12, 1987, abandoned, which is a continuation-in-part of Ser. No. 711,263, Mar. 13, 1985, abandoned.

[51] Int. Cl.[5] ..... G06F 15/44

[52] U.S. Cl. ..... 364/410; 273/32 R

[58] Field of Search ..... 273/32 R

[56] References Cited

U.S. PATENT DOCUMENTS

| | | | |
|---|---|---|---|
| 3,898,437 | 8/1975 | Butler | 235/95 R |
| 4,103,983 | 1/1978 | Morrison et al. | 248/201 X |
| 4,140,404 | 2/1979 | Kaenel | 400/120 |
| 4,192,510 | 3/1980 | Miller | 273/176 A |
| 4,236,152 | 11/1980 | Masuzawa et al. | 340/747 |
| 4,266,214 | 5/1981 | Peters, Jr. | 340/323 R |
| 4,268,744 | 5/1981 | McGeary | 235/375 |
| 4,319,131 | 3/1982 | McGeary et al. | 235/375 |
| 4,365,305 | 12/1982 | McDonald et al. | 364/521 |
| 4,367,526 | 1/1983 | McGeary et al. | 377/5 |
| 4,419,655 | 12/1983 | May | 340/323 R |
| 4,480,310 | 10/1984 | Alvarez | 364/444 X |
| 4,492,582 | 1/1985 | Chang et al. | 434/169 |
| 4,555,699 | 11/1985 | Citron et al. | 340/707 |
| 4,572,512 | 2/1986 | Tegart | 273/176 A |
| 4,597,058 | 6/1986 | Izumi et al. | 364/900 |
| 4,639,583 | 1/1987 | Zerowin | 235/380 |
| 4,648,066 | 3/1987 | Pitt | 364/900 |
| 4,673,872 | 6/1987 | Germer et al. | 324/103 R |
| 4,680,731 | 7/1987 | Izumi et al. | 364/900 |
| 4,698,781 | 10/1987 | Cockerell, Jr. | 364/460 X |
| 4,910,677 | 3/1990 | Remedio et al. | 364/410 |

OTHER PUBLICATIONS

Hamerdinger et al., "Electronic Score Pad", *Navy Technical Disclosure Bulletin*, vol. 9, No. 2, 12/1983.

Tazaki et al., "Guiding Device for Golf Links", *Patent Abstracts of Jap.*, p. 487, 61-67169, 4/1986.

Harada, "Terminal Equipment for Golf Course", *Patent Abstracts of Jap.*, p. 765, 63-116266, 5/1988.

*Primary Examiner*—Dale M. Shaw
*Assistant Examiner*—David Huntley
*Attorney, Agent, or Firm*—Kenneth E. Merklen

[57] ABSTRACT

A golf cart computer for installation in a golf cart. The computer contains a display screen for showing graphically the details and features of each hole of a golf course. It has memory for containing the graphic details of the course and for containing scores of each player. The computer has a keyboard for entering scores and players' bets and other information. In a preferred embodiment, the computer has a slot for a memory cartridge which can be transferred to a stationary printing station so that the driver of the golf cart can receive a print-out of the accumulated scores therefrom. In one version of the invention, a light pen is connected to the computer for marking selected locations on the display screen, and the computer is capable of computing and displaying distances between selected features of the golf course including the ball.

2 Claims, 13 Drawing Sheets

FIG. 1
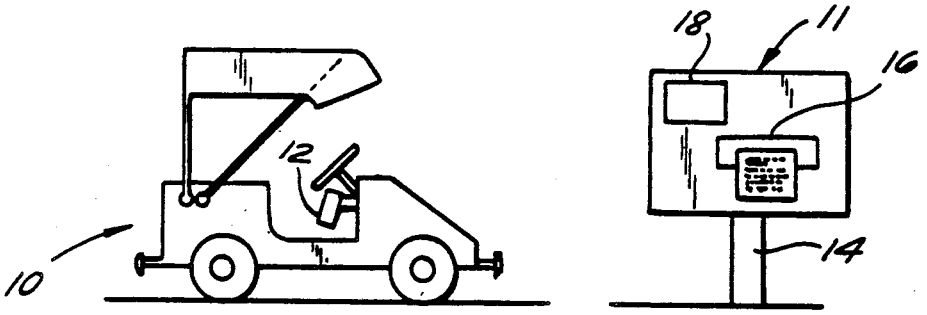
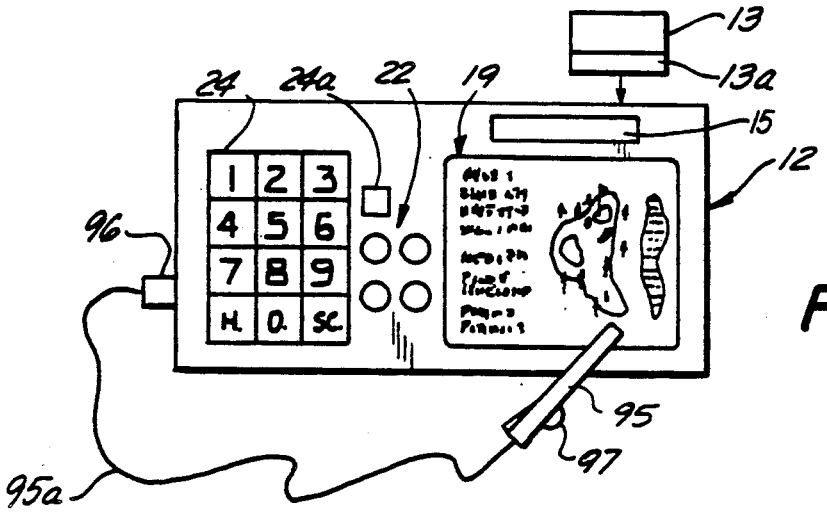
FIG. 2
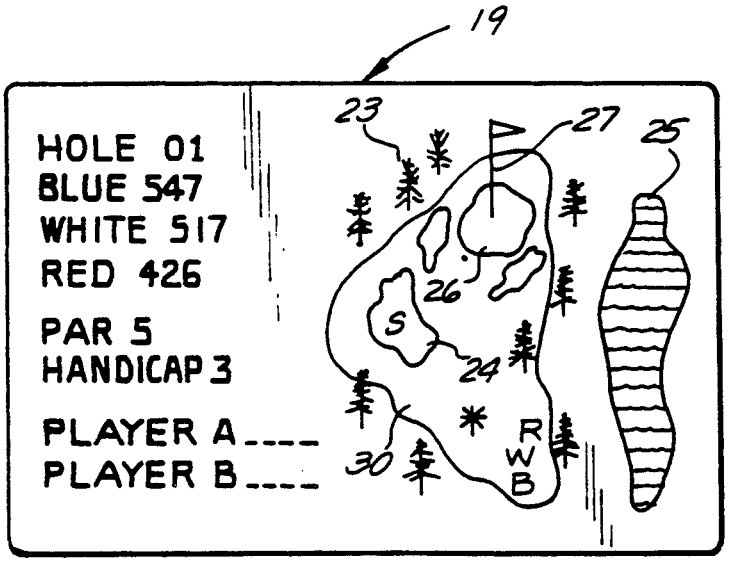
FIG. 3

FIG. 8

LEFT FAIRWAY

1 SANDTRAPS

2 PINE TREES

3 DOG LEG LEFT

RIGHT FAIRWAY

1 SANDTRAPS

2 TOUGH ROUGH

3 LAST 100 YD'S WATER D-3

HOLE 1
BLUE 547
WHITE 517
RED 416

PAR 5
HANDICAP 3

PLAYER A_____
PLAYER B_____

| | | | | | | | | | | |
|---|---|---|---|---|---|---|---|---|---|---|
| X1=28 | V | 4.42 | 4.56 | 4.93 | 4.82 | | 6.41 | 6.01 | 5.12 | 4.41 |
| Y1=31 | α | .098 | .196 | .295 | .393 | | 5.989 | 6.087 | 6.185 | 6.283 |

| | | | | | | |
|---|---|---|---|---|---|---|
| X2 | 00 | 01 | 02 | | 57 | 58 |
| Y2 | 85 | 86 | 86 | | 100 | 100 |

GOLF CART COMPUTER WITH CARTRIDGE STORAGE

This is a continuation of Ser. No. 07/300,227, filed Jan. 23, 1989, now abandoned. Ser. No. 07/300,227 is a continuation of Ser. No. 07/014,027, filed Feb. 12, 1987, now abandoned. Ser. No. 07/014,027 is a continuation-in-part of Ser. No. 06/711,263, filed Mar. 13, 1985, now abandoned.

FIELD OF THE INVENTION

The invention relates to golf cart computers, and more particularly, to a computer attached to a golf cart for keeping scores and for displaying graphics and data relating to the golf course, and for producing a score card for each player.

BACKGROUND

Golf players playing on a course consisting of typically nine or eighteen holes, in the course of playing a hole, often would like to know details in regard to distances between various features of the course and their mutual location, in particular, features such as sand traps, trees, water holes, and slope of the terrain are desirable, in order to be able to play a better game.

PRIOR ART

Inventors have in the past sought ways to help golf players improve their score.

U.S. Pat. No. 3,898,437 shows a golf cart with a built-in yardage indicator to show the player the approximate distance travelled from the tee-off point.

U.S. Pat. No. 4,367,526 shows a hand-held golf calculator on which a player can keep scores and which may contain data on the course, the players and contest arrangements.

U.S. Pat. No. 4,419,655 shows a display device which contains pictorial presentations of each hole with electric indicators showing special features that are of interest to the players.

The inventor of the instant invention believes that none of the prior art provides a golf player with an adequate diversity of information that would be desirable under many different playing conditions.

It is therefore an object of the present invention to provide a golf cart computer that provides a wide range of information for a golf player during the game.

It is a further object to provide a golf cart computer that has a keyboard and memory on which each player in a team can keep his scores for each hole and a display screen on which he can recall scores from previously played holes.

Further, it is an object to provide a golf cart computer that has stored in memory, data and distances and locations of various features of the course such as locatin of traps, water holes, putting green, the hole and so forth, that can be displayed in graphic form on the screen.

It is still another object to provide a golf cart computer that can interact with a printout device located at the end of the course on which the total scores of each player can be summed up and printed out on a score card.

SUMMARY OF THE INVENTION

The golf cart computer according to the teachings of the instant invention comprises a self-contained golf cart computer with a keyboard and a display screen which can be mounted on the cart's dashboard, preferably on the right hand side of the steering wheel. The computer is preferably powered from the golf cart's electric storage batteries with additional back-up power. It contains electronic memory including a plug-in memory cartridge which has stored therein a wide range of information, pictorial presentations, and data which the golf player can display on demand on the screen during the game. In particular, the player can call out pictorial presentations of any hole with sand traps, water, trees, etc. around the hole. Also, distances between the features may be displayed and optionally terrain slopes may be displayed. Also, graphical presentations of the fairways and location of the obstructions may be displayed.

It is recognized that graphic presentations require a considerable amount of storage memory, that may not be conveniently stored in a small dashboard mounted computer. In order to overcome this problem, the instant invention teaches a method for economically storing the graphics presentations by means of a catalog of symbols such as trees, traps, greens etc. in vector graphic form that can be called from the catalog and displayed with proper coordinates and orientations on the screen. By that means, a common catalog of symbols can be used for many holes and considerable memory size can be saved.

The computer also contains memory locations for containing each player's score for each hole and the players can, on demand, recall the scores for previously played holes, and at the end of the game, the computer may compute each player's total score, and include handicaps and other information as desired.

In an especially advantageous embodiment of the invention, the player, when returning to the clubhouse, may stop at a printout location where a stationary apparatus with a printer with a slot for receiving the memory cartridge receives the scores and prints out a score card for each player and, if desired, his standing and/or handicaps.

In the preferred embodiment, the golf computer includes a receiver for the storage cartridge for storing data related to the played round of golf for each player. The storage cartridge includes electronic memory of sufficient capacity to store temporarily data relating to the played round of golf, a battery of sufficient capacity to maintain the storage memory and the control circuits therefor for a sufficient length of time to allow the cartridge to be moved from the golf computer to a receiving slot at the printing station for printing out the data. Further still the cartridge memory may be controlled, through its connector, by the cart computer or the printing station computer, depending upon the computer with which it is connected, or it may include internal memory control and fault-monitoring circuits for communicating with the computer in the golf cart and in the printing location.

The cartridge may advantageously include a solid-state memory of the type known as "non-volatile", i.e. the memory cells are capable of being electrically erasable and re-written, and is capable of retaining the stored information indefinitely without an external power supply. Memories of this type are also known as "EPROM" (for Electrically Programmable Read Only Memory).

Another type of suitable memory is of the known type that is capable of retaining the stored information with the help of a standby battery for supplying a small amount of standby current, just adequate for retaining the stored information.

Further objects and advantages of this invention will be apparent from the following detailed description of a presently preferred embodiment which is illustrated schematically in the accompanying drawings.

BRIEF DESCRIPTION OF THE DRAWINGS

FIG. 1 shows a golf cart with a dashboard mounted computer adjacent the printout station, and a printing station with a cartridge receiver.

FIG. 2 shows the face of the golf cart computer with a graphic display of a hole on the display screen and a keyboard and a cartridge being inserted thereinto.

FIG. 3 shows a more detailed view of the display screen showing a fairway with a hole surrounded by traps and trees;

Figure 12:
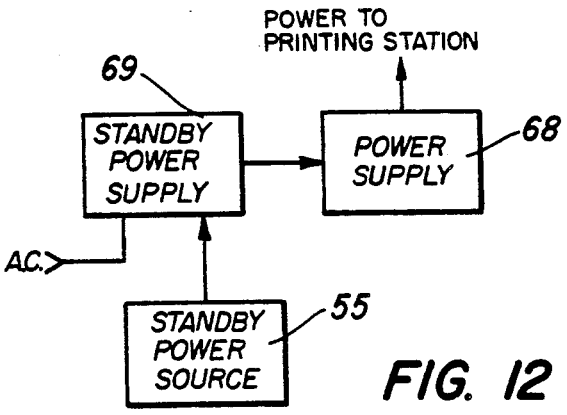
Figure 9:
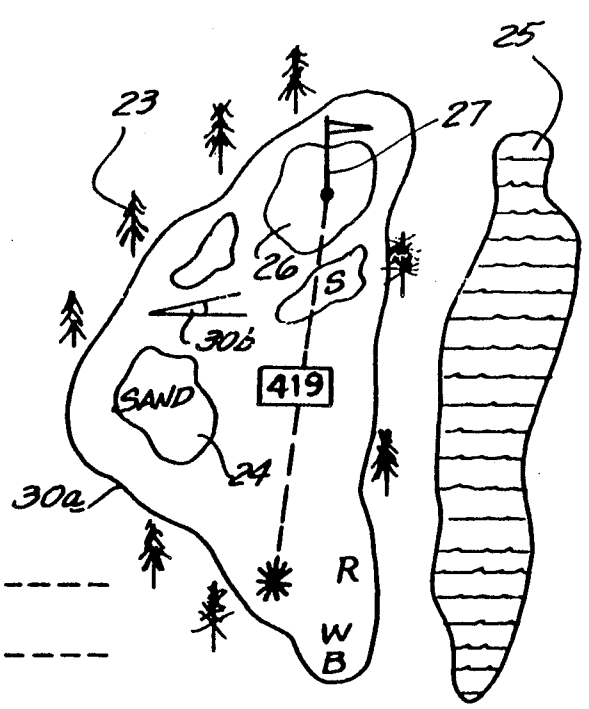
Figures 10, 11A, 11B:
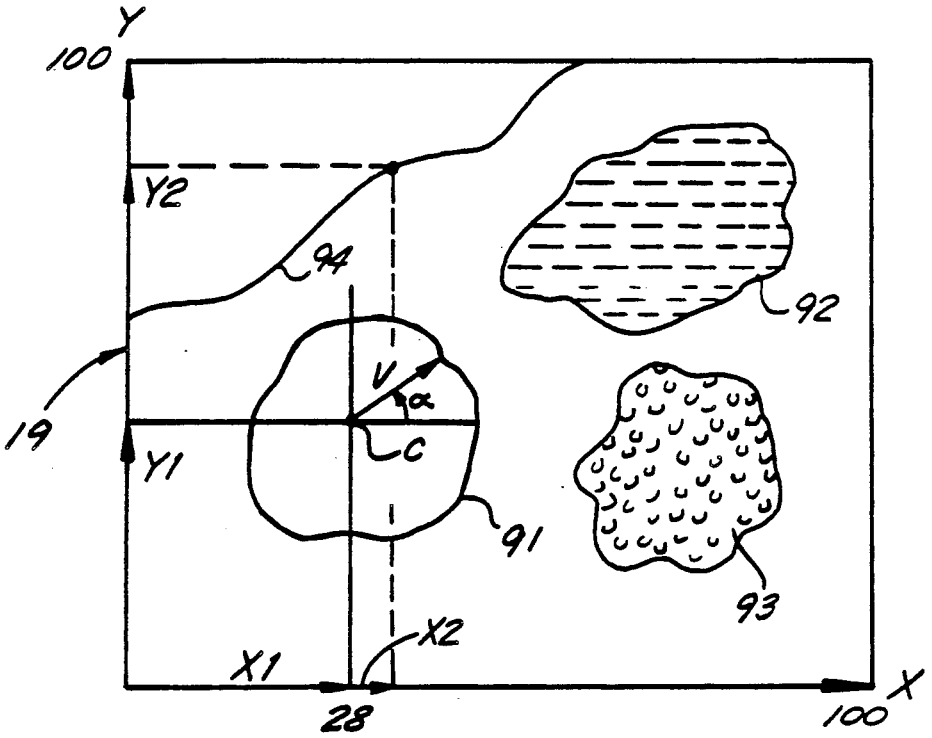
Figure 13:
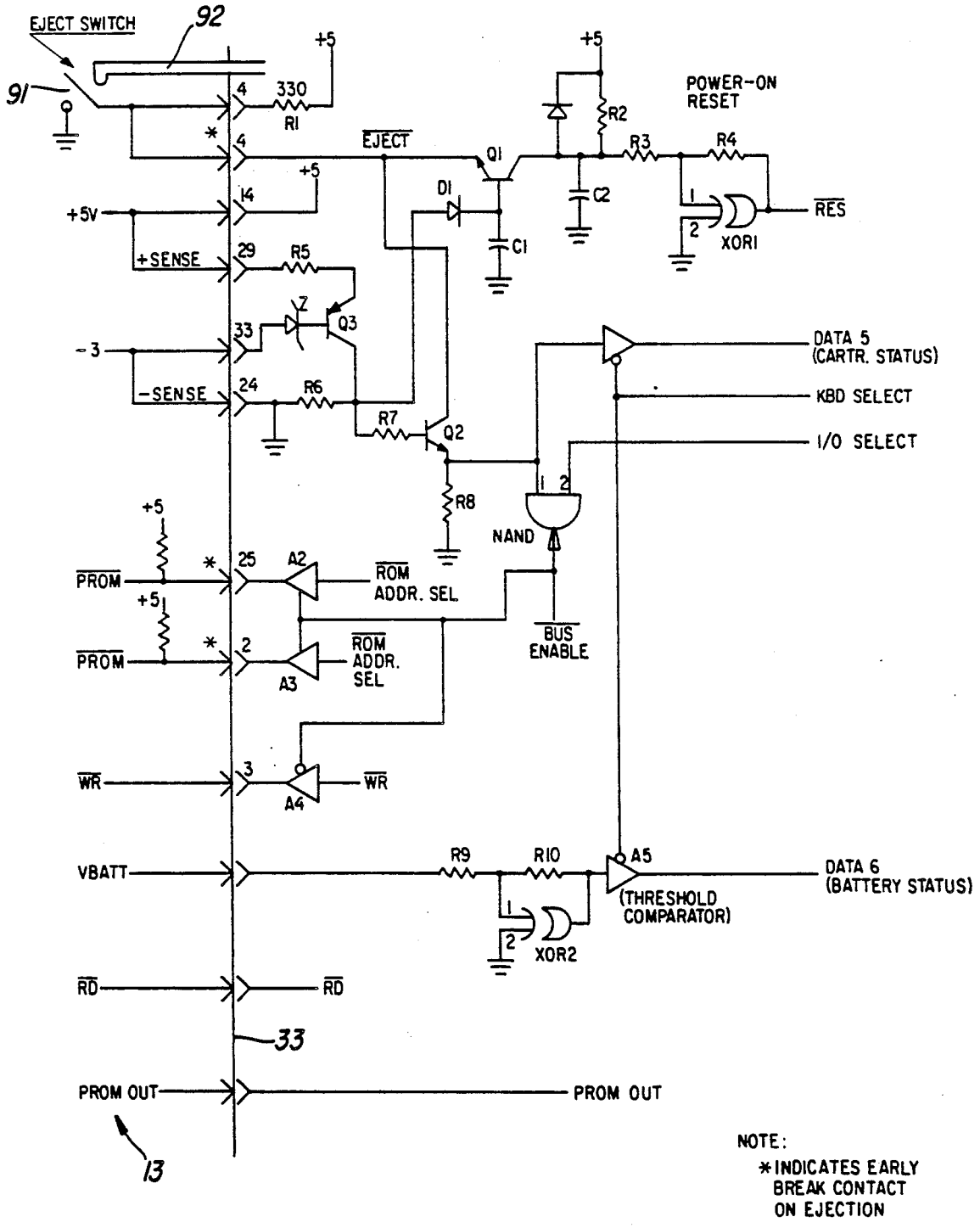

FIGS. *7a* and *b* are flow charts of the major steps in the operation of the golf cart computer and its interaction with the printing computer;

FIG. 8 is an all alpha-numeric display of data for two fairways;

FIG. 9 is an enlarged view of a combined graphic display of a fairway with putting green and an alphanumeric display;

FIG. 10 shows typical examples of graphic presentations of golf course features on a picture screen;

FIG. 11*a* shows a typical data table of coordinates for graphic presentation in polar coordinates;

FIG. 11*b* shows a typical data table of coordinates for graphic presentation in cartesian coordinates;

FIG. 12 is a power supply for the printing station;

FIG. 13 is a schematic circuit diagram of the cartridge interconnection with a computer.

Figure 14:
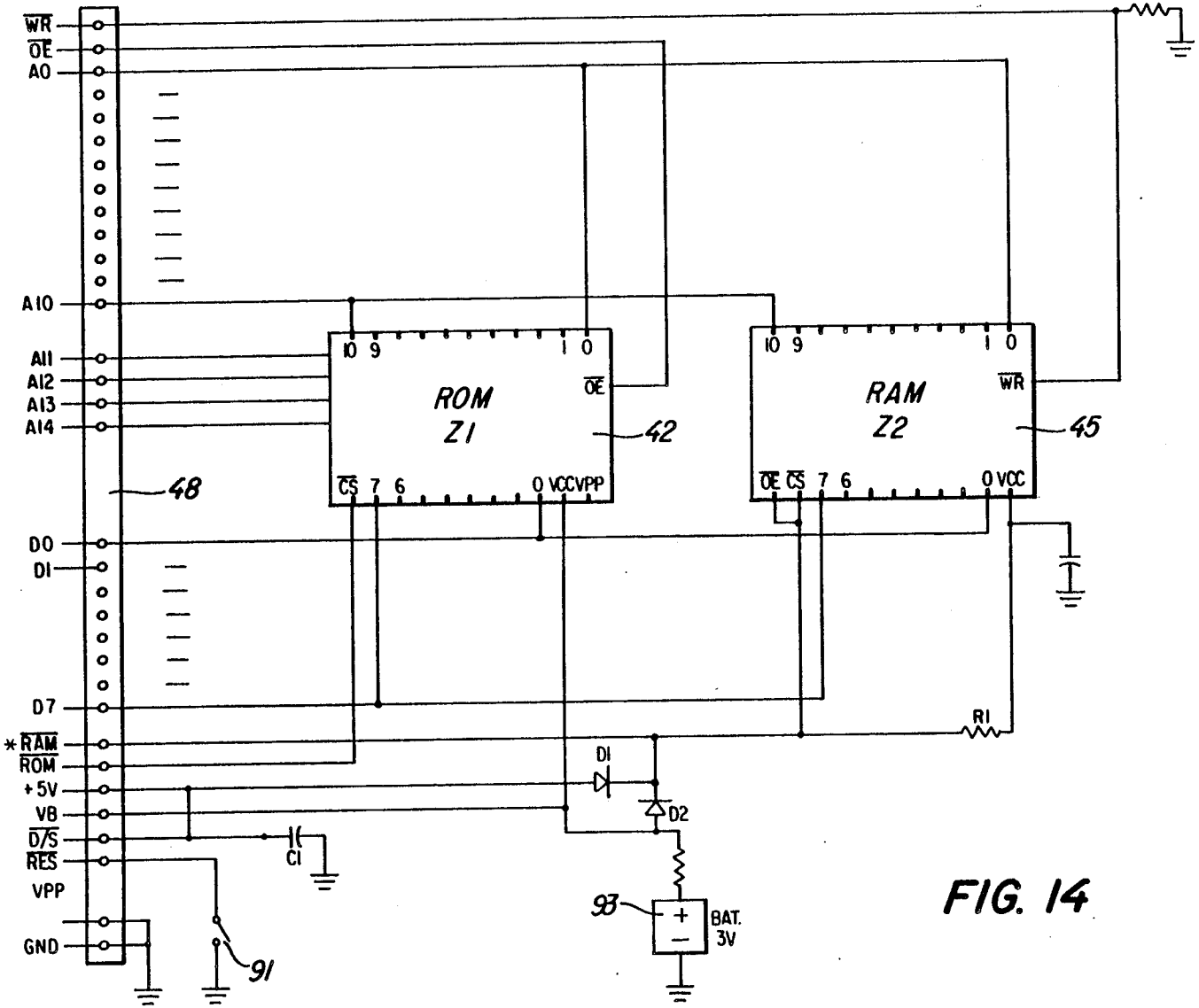

FIG. 14 is a schematic circuit diagram of the memory cartridge.

Figure 15:
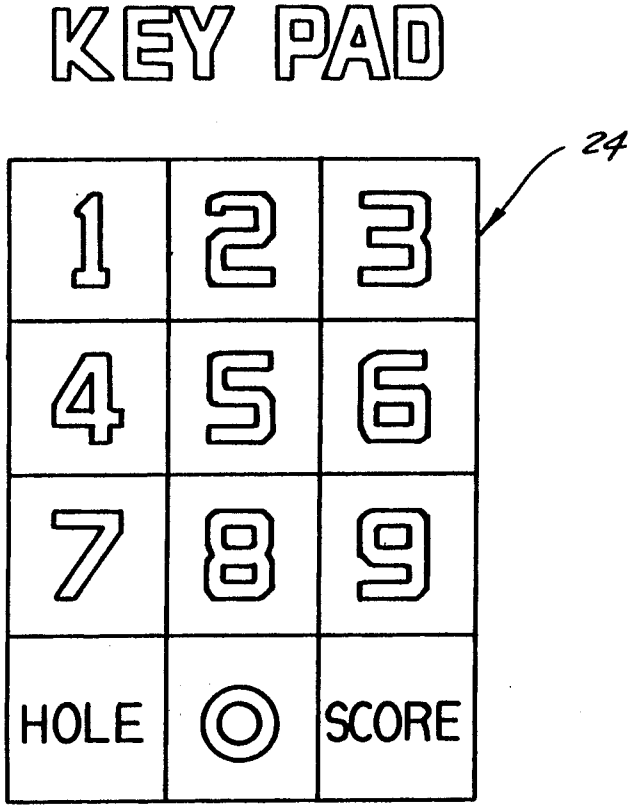

FIG. 15 is an enlarged view of a keyboard with keys.

Figure 16:
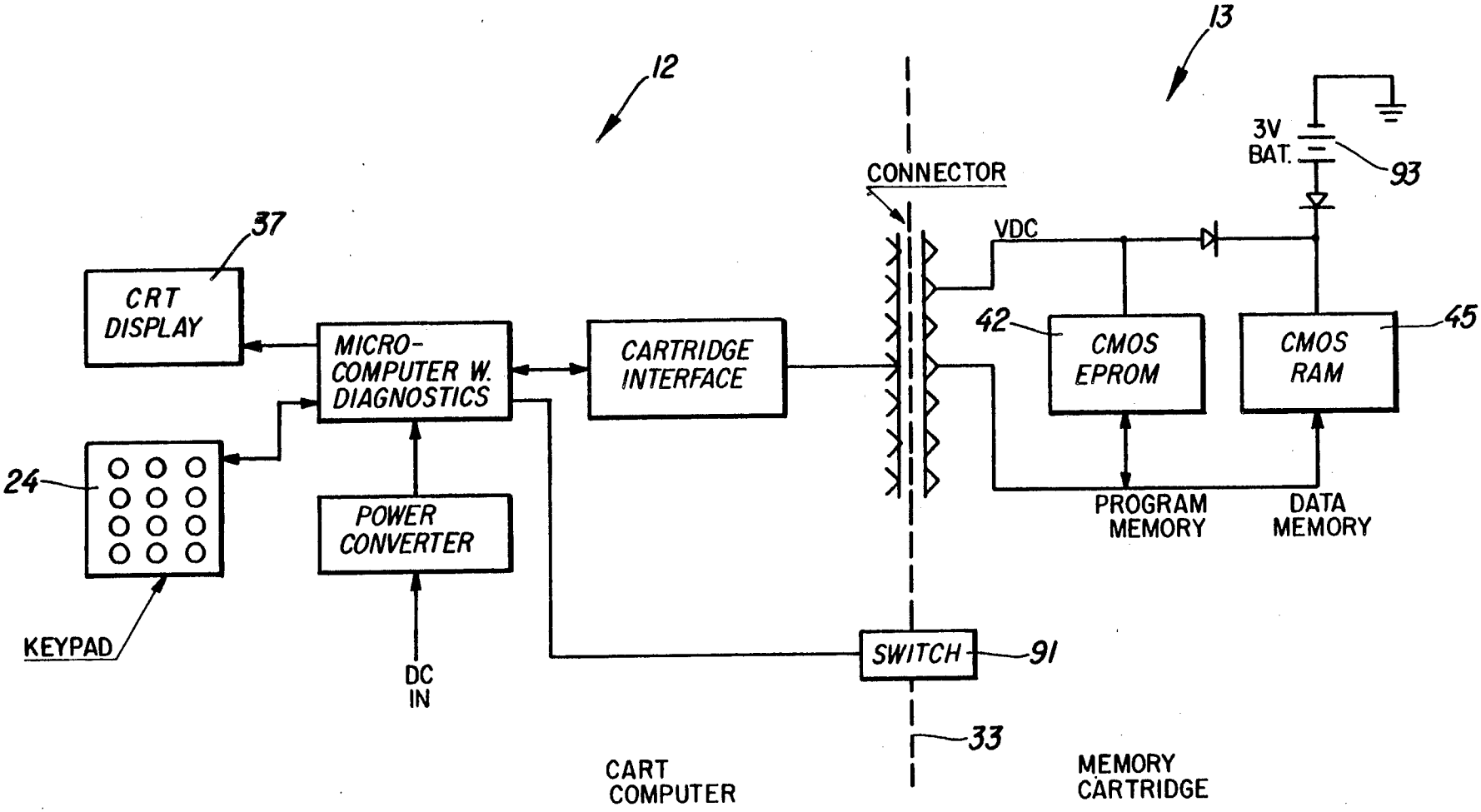

FIG. 16 is a block diagram of the cart computer, the memory cartridge, the plug-in connection therebetween, and other details.

Figure 17:
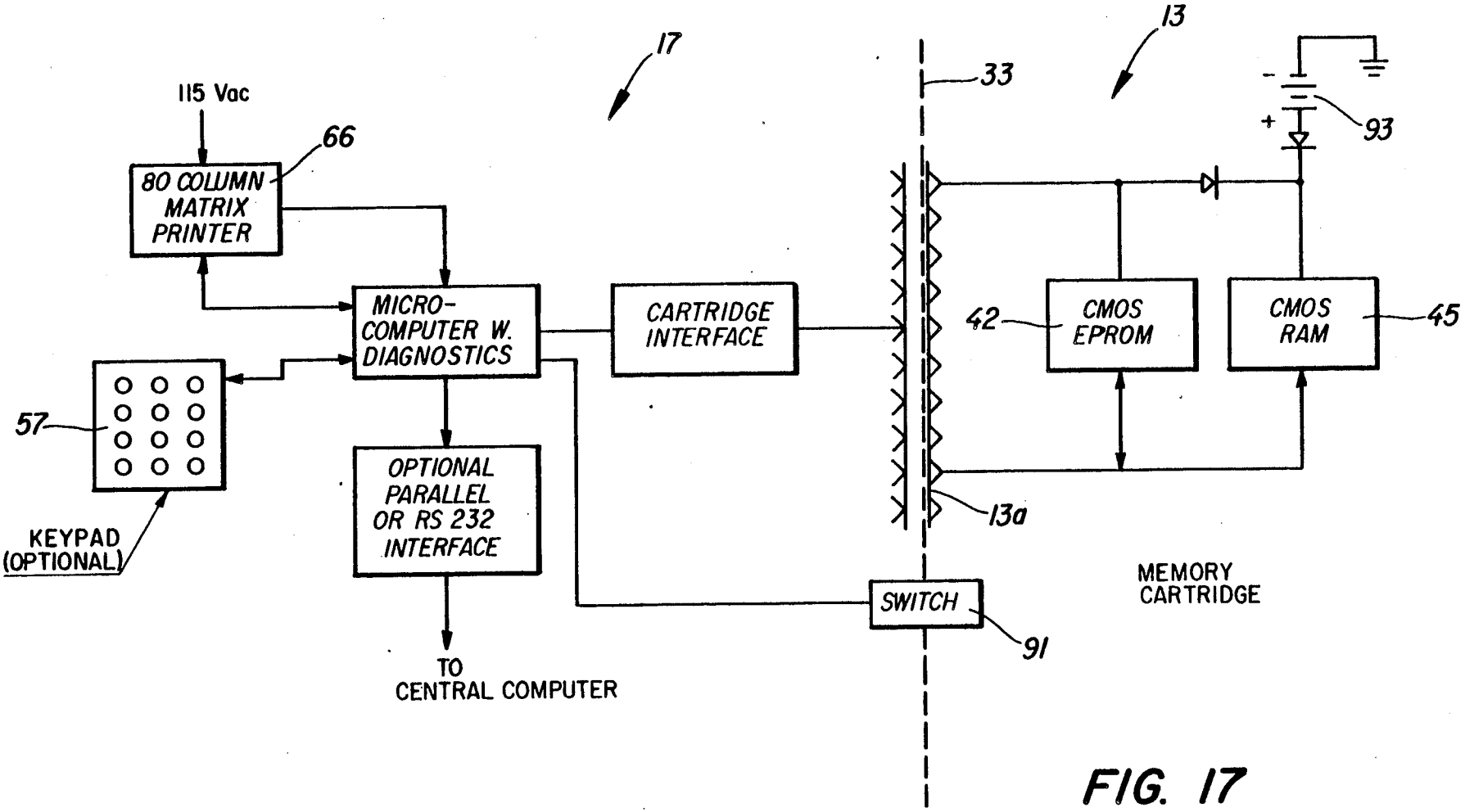

FIG. 17 is a block diagram of the central computer, the memory cartridge, the plug-in connector therebetween, and other details.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

FIG. 1 is an illustration showing generally a golf cart 10 having a golf cart computer 12 installed e.g. on the dashboard of the golf cart. A printer station 11 contains electronic computing and printer control apparatus installed in a housing mounted on a pedestal 14 and conveniently located where the golfers return with the golf carts after a game.

The golf cart computer 12 includes a receiving slot 15 for a removable memory cartridge 13 (FIG. 2) which serves to store electronic data relating to scores played by one or several players in a round of golf. The cartridge 13 also advantageously includes data specifically representing the features of the respective golf course that has been played by the golfers. The cartridge 13 is detachably connected to the golf cart computer by means of a plug-in connection between pins 13*a* and mating pins in the golf cart computer.

FIG. 2 also shows the face of the golf cart computer 12, including a viewing screen 19, a keyboard 24 and various tuning and adjustment buttons 22 which also include an on-off switch 24*a*. The viewing screen 19 shows as an example a graphic presentation of a hole of the golf course shown in more detail in FIG. 3, e.g. hole "01" showing sand traps 24, a green 26, a waterhole 25, a flag 27, etc. A light pen 95 is connected by a cord 95*a* and a plug 96 to the computer 12.

The light pen 95 per se is a conventional input device used inter-actively with computer screens to identify a certain location on the screen and to mark the point of the location by its coordinates x, y (FIG. 10) on the screen. It can be used to point to areas of the screen and thus indicate a selection from a displayed list, or it can be used to draw shapes. The light pen has a photosensor at the tip that responds to the peak illumination that occurs when the CRT scanning spot passes its point of focus. The display system correlates the timing of the pulse from the photosensor with the timing of the display scan to determine the position of the light pen.

When the light pen is used to identify points, the difficulties of parallax—due to thickness of the screen—and the lack of a fine point at the tip of the pen are overcome by use of a tracking cross. The display system generates a fine-line tracking cross and positions it so that its intersection is central in the field of view of the light pen. As the light pen is moved across the screen the tracking cross follows it closely and the path of the intersection point is stored in the display file. A switch 97—usually on the pen—is used to indicate the intended point of the screen, which is then marked, e.g. with an asterisk which stays at that point of the screen until the screen display is erased. Since the coordinates of the asterisk stay in the computer's memory, e.g. the Video RAM 40 (FIG. 4), it is accessible to the computer's control program and the computer is capable of computing and displaying the physical distance from the asterisk to any other feature of the golf course, or the particular hole, which is defined in the computer's graphics memory 42.

FIG. 3 shows, as an example, a graphic presentation of the details of a section of the golf course that may be of interest to a golfer. In FIG. 3 it is assumed that the golf cart is located at the asterisk * at the lower left hand corner of the graphic screen display. A waterhole 25 is shown, as well as the green 26, the flag 27, three sand traps 24, and trees 23. It follows that other graphic information may be presented at the selection of the player such as distances, terrain, slopes and so forth by calling out codes for the desired presentations at the keyboard 24.

The screen display 19 also shows at its left hand side alpha numerical information that is of interest to the players. The information shown as an example covers the hole number (01), the distance to the flag from tee blue, white and red, the hole par value (5), handicap (3) and the cumulative scores for two players A and B, as the scores are being entered during the game. It follows that other alpha numerical information, as it may be found desirable, may be added to the display.

Figure 4:
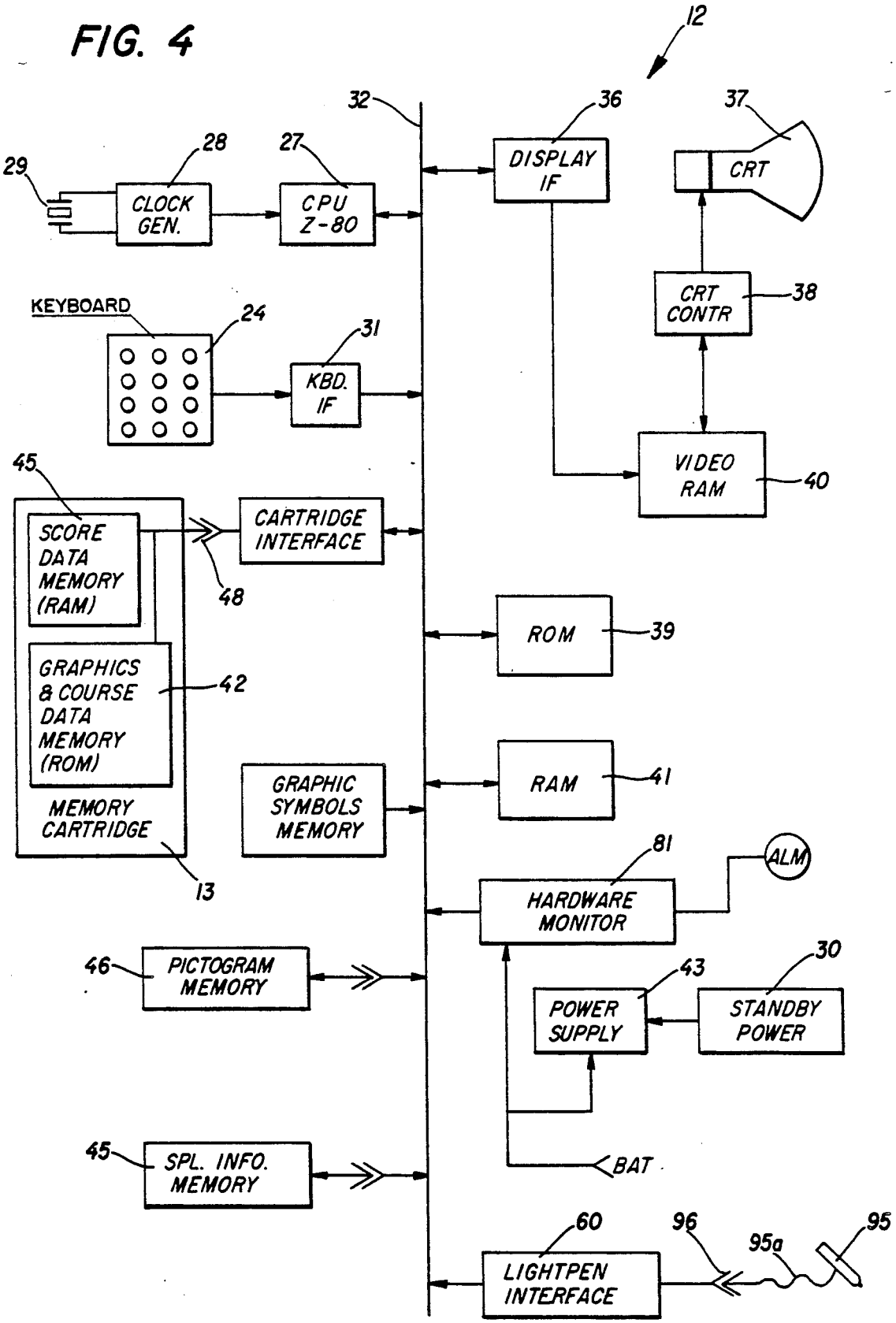
FIG. 4 shows a schematic block diagram of the golf cart computer with the major function blocks and their interconnections.

FIG. 4 is a schematic block diagram of the golf cart computer showing its major function blocks. The heart of the computer is the central processing unit (CPU) 27 which may be any one of many types commercially available. In an operational realization of the invention, a CPU of the type Z-80 manufactured by the Zilog Corporation was used, but the exact choice of the type of CPU used is immaterial to the scope of the invention.

The CPU 27 is drive by a clock pulse generator 28, which is in turn controlled by a crystal 29 of any suitable frequency which may typically be 10,180 MHz. The clock generator 28 generates a number of clock frequencies as required for the operation of the computer.

The CPU communicates with the various function blocks via a computer bus 32 of the latter. A read-only-memory (ROM) 39 contains the control programs that control all functions of the computer. The programs consist, as is conventional, of listings of binary encoded instructions and commands which are read and executed by the CPU one at a time. The construction of such computer programs is a well known art and is described in numerous textbooks such as *Microcomputer-Based Design* by John B. Peatman published by McGraw Hill and others.

A random access memory (RAM) 41 stores all transient data such as the players' scores, transient computations by the computer and so forth. The keyboard 24 with a keyboard interface 31 serves to receive commands, data and other inputs from the players during the use of the computer. A graphics memory 42 contains all the graphics data required to present the graphic presentations of the features of the particular golf course. The graphics memory 42 is advantageously included in the memory cartridge 13 with a plug-in connection 48 so that the features of various courses and various classes of features or changes thereto can be stored in the cartridge 13, which can be conveniently inserted into the computer cartridge receiver 15 at the start of a game.

It should be understood that storing all the topographical details of a golf course in pictorial form may require a considerable amount of memory capability that it may not normally be economical to provide in a memory cartridge. It is, therefore, contemplated that a type of abbreviated graphics which comprises a library of standard pictograms representing various repetitively encountered features of the golf course be stored in a pictogram memory 46 which may be a part of the ROM memory 39. Examples of such standard pictograms may be trees, sand traps and water holes in various forms which can be recalled repeatedly and modified as required.

A special information memory 45 may optionally be provided as part of the memory cartridge for providing information about the golf course that may vary from time to time, such as the conditions of the fairways, temporary changes and so forth.

At the end of a game, when a player returns the golf cart, he removes the cartridge 13 from the cart computer 12 and takes it to the aforesaid printing station 11.

The display screen 19 is advantageously formed by a cathode ray tube (CRT) 37, of the type well known from TV sets and the like, but it may alternatively be a flat screen display such as an LCD or plasma display or any other suitable display device. In the case of using a CRT, it is controlled by a CRT control circuit (CRT CONTR) 38 which provides the control potentials for steering the electron beam, including horizontal and vertical controls and others, as is well known from the art of CRT displays. A video random access memory (VIDEO RAM) 40 stores temporarily all the picture elements of the picture presented on the CRT screen. It contains at least as many memory bits as there are picture elements in the picture. A RAM memory containing 256×256 bits, and consisting of four (4) 5516 memory chips has been found to work well.

The VIDEO RAM memory 40 is connected to the computer bus 32 via a display interface (DISPL IF) 36, consisting essentially of a commercially available electronic chip 6845 which interacts with the CPU 27, to enter a new picture from the graphic memory, whenever a new picture is called for. Once a picture is entered into the video memory 40, the memory keeps refreshing the picture on the screen under control of the CRT CONTR 38, until a new picture is entered.

Figure 6:
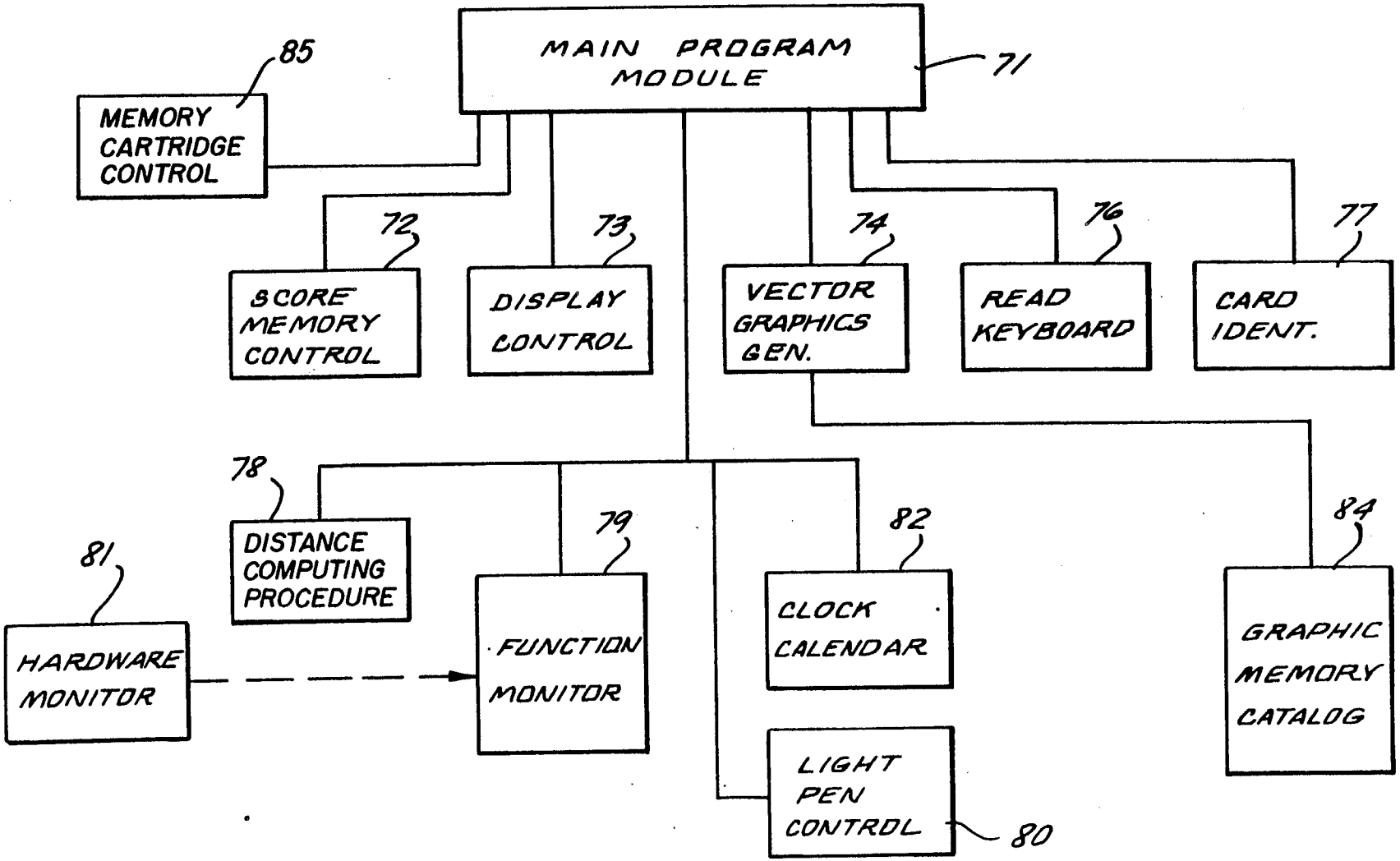
FIG. 6 is a block diagram of the major software modules of the control program of the golf cart computer.

A hardware monitor 81 is a monitor circuit that continuously monitors all the functions of the golf cart computer 12 for proper performance under control of the computer control program designated as the function monitor module 79, shown in FIG. 6. Such function monitor systems are well known in most computer systems and provide an alarm or other suitable indication to the user of the system. Electric power for the golf cart computer 12 is drawn primarily from the battery (BAT) for the golf cart, and a standby power circuit 30 may be provided which contains a separate battery that insures that the information stored in the RAM is not lost in case the golf cart battery should fail.

Figure 5:
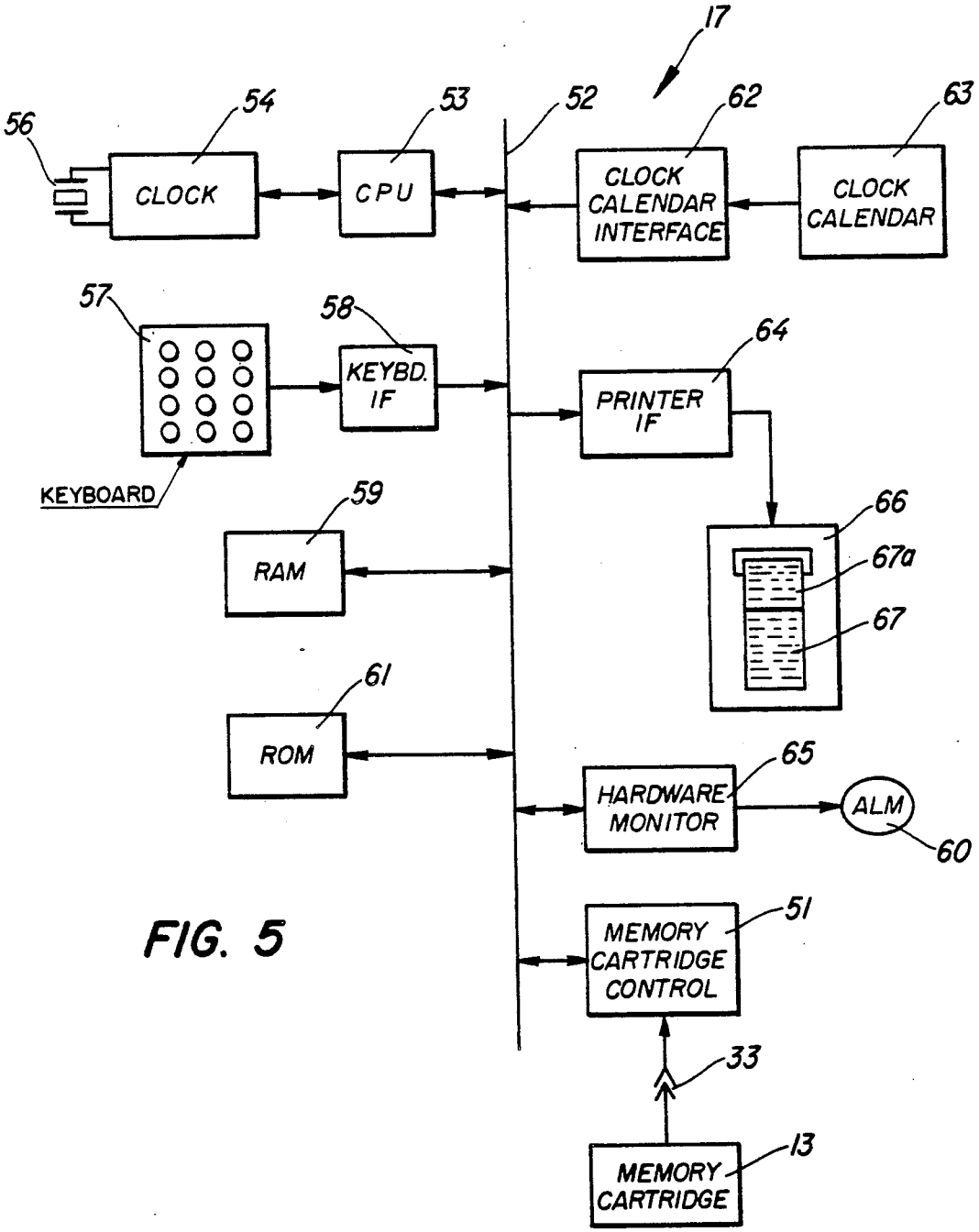
FIG. 5 shows a schematic block diagram of the printing station's computer with the major function blocks and their interconnections.

FIG. 5 is a functional block diagram of the printer control apparatus 17 of the printing station 11 of FIG. 1.

In FIG. 5, a CPU 53 is the central processing unit of the printer control 17, connected to a clock circuit 54, controlled by a crystal 56. A central bus 52 connects the CPU 53 with the other parts of the control, which include: a clock calendar 63 connected to a clock calendar bus interface 62, a printer bus interface 64; a keyboard 57 with keyboard bus interface 58, RAM 59 and ROM 61 memories for storing data; a hardware monitor 65 with an alarm 60 and a memory cartridge control 51 having a plug-in connection 33 to the memory cartridge 13.

The printer 66 may be any suitable computer controllable printer suited for printing a score card.

FIG. 6 is a functional block diagram of the control program stored in the golf cart computer's ROM 39. In accordance with known principles, the control programs consist of a plurality of program modules that each serve an identifiable function which is part of the total control program. In a typical organization of the control program, a main program module 71 maintains overall control of the entire program and calls into operation every subordinate module whenever needed. The subordinate program modules include: memory cartridge control module 85 that controls all functions of the cartridge and checks that it is functional, e.g. has operating power and so forth; a score memory control module 72 that stores each players' scores as they are entered during the game; it may also have provision for storing separate bets between players as may be desired. The actual storing of the numbers takes place in the RAM 41, under control of the score memory control module 72; a display control module 73 for controlling the functions of the display screen, e.g. the CRT 37; a vector graphics generator 74 produces the graphic and feature symbols, and information to be displayed on the CRT 37, a read keyboard module 76 continuously scans the keyboard 24 in order to read manual inputs; an optional cart identity module 77 may be provided in case the cart identity such as the cart number is needed for printout on the score card or for other purposes. A function monitor module 79 checks all the elements of the golf cart computer to ensure that all its elements, e.g. the keyboard 24, the power supply 43, the CRT 37, the memory cartridge 45 and so forth are operational. It is closely associated with a hardware monitor 81, and any functional disorder detected will be indicated on the CRT 37 or presented on an indicator lamp ALM or the like; an optional clock calendar module 82 continuously maintains time and date in software for each transaction for later printout if desired by the players; a graphic symbols catalog memory module 84 contains all the basic symbols and characters required by the vector graphics module 74. A light pen control module 80 controls the operation of the light pen 95.

It should be understood that the control program may be organized in other ways according to the preferences of the designer of the programs and the details of the tasks to be performed.

Figure 7A:
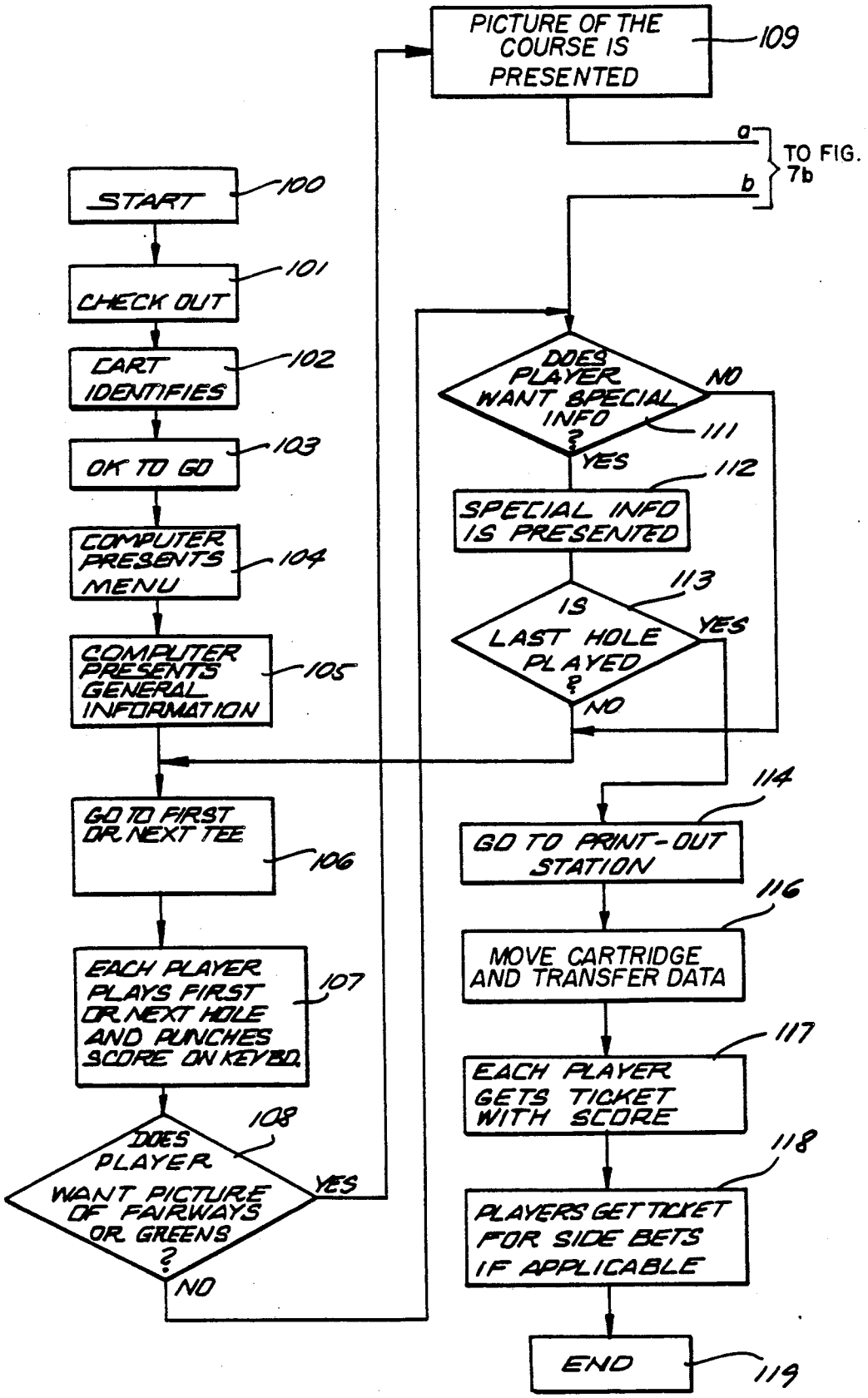

FIG. 7 is a flow chart program that forms the basis for constructing the control programs, and shows, step-by-step the operation of the golf cart computer and its interaction with the printing station. Some of the steps are operational and may not be used in certain types of operation.

The program begins at Start 100. As the golf cart is checked out from the parking area, a maintenance person may peform a check out in step 101 in which he enters his name or initials or personal code at the keyboard 57. The cart may pass a check-out station in step 102, and the cart is O.K.'d to leave in step 103. The players are next to identify themselves to the golf cart computer in step 104, in which a start dialogue is presented on the screen which guides the players through the dialogue in which they enter their names, handicaps, side bets and so on, according to established rules.

The computer may present in step 105 some general information to the players, such as special conditions of the course, precautions, special charges and rules and so forth. In step 106, the driver moves to the first or next hole as the case may be. As each hole is played each player punches his score on the keyboard as shown in step 107. A player can, by looking at the screen, see the features of the fairways and greens displayed in relation to his instant position. By placing the tip of the light pen 95 at the point of the screen which represents his position and pushing the light pen switch 97, it will be stored in memory and identified by its coordinates x and y as described hereinabove and marked on the screen with a distinctive mark, e.g. an "X". The computer can next, based on the coordinates of the player's position and the coordinates of any other feature similarly marked by the light pen, determine the distance between those points, and display them on demand, in response to the player entering appropriate codes on the keyboard for calling out those distances and any other related information, so that he can plan his next stroke for the best possible result.

Any such other information than the graphics presentation, which the player may request, are indicated by steps 111 and 112. For each hole played, the sequence consisting of steps 106 through 113 is repeated. The step 113 serves to determine if the last hole has been played. If the answer is yes, the driver goes to the printing station in step 114.

Figure 7B:
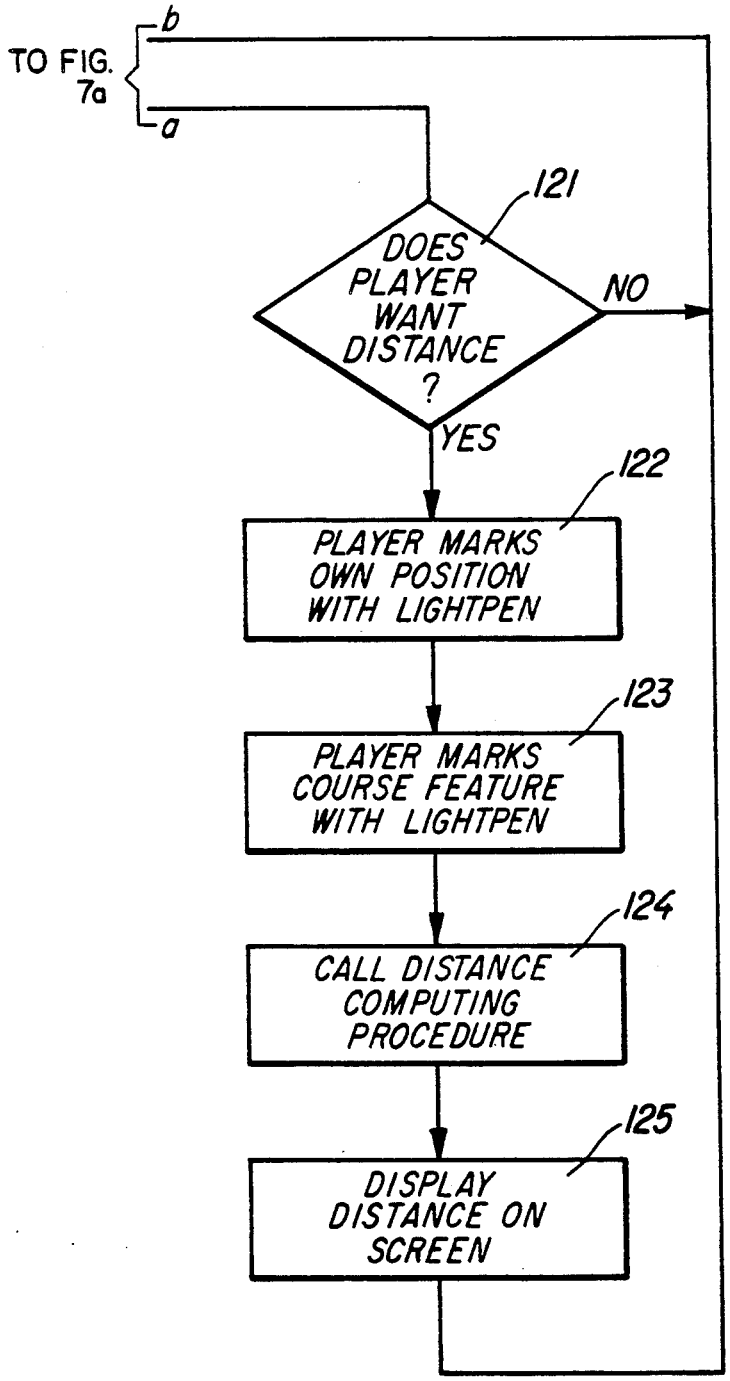

The flow chart section on FIG. 7*b* shows the steps performed by a player who wishes to find distance to a certain feature or point on the golf course, as decided in step 121. If the answer is YES, the player marks his own position on the point of the screen representing his position, with the light pen, and his position is marked, e.g. with an "X" in step 122. Next in step 123 he marks on the screen with the light pen a given feature or spot on the source to which he wishes to know the distance. In step 124, he calls a distance-computing procedure from the keyboard 24, and the computer will compute and display the distance e.g. in feet, on the screen, as shown in step 125.

At the printing station 11 the memory cartridge is inserted into the cartridge receive slot 18 and transfers the data thereto, as shown in step 116.

After computing and printing the score, each player tears off his score card from the score card printer 66 in step 117. If there are side bets, each bet is computed on the score card which is torn off in step 118 and the transaction is completed in step 119.

FIG. 8 is an example of a display of information which consists entirely of word descriptions of the fairway which may be all a player wants under some circumstances.

FIG. 9 is another example of a display which consists of both word descriptions and a simple pictorial presentation of the fairway with the greens, the hole and various traps, which was described in more detail in connection with FIG. 3.

FIG. 9 shows as an example a dotted line from the asterisk * to the flag 27, indicating the distance therebetween as 419 yards, which may be displayed in response to a selected command code at the keyboard 24. The terrain slope may be indicated on demand as shown in the symbol 30*b*.

Generally stated, there is no limit to the types and amount of information that can be made available to the players using the golf cart computer according to the invention; only the size of the storage memory that is required to produce the pictorial presentations presents a limit.

It is possible to use a special technique for reducing the size of memory required, generally known as vector graphics, which is especially well suited with the present invention.

FIGS. 10 and 11*a* and 11*b* illustrate such an especially suitable method, for the present invention, of vector graphics to save memory. FIG. 10 shows examples of pictures on the viewing screen 19 of the CRT 37. A FIG. 91 may represent the outline of a sand trap, a water hole, a tree or any other feature. The center c of the feature may be indicated by coordinates x1, y1. The end of the vector V rotating an angle alpha about the center c describes the outline 91 of the feature.

The table shown in FIG. 11*a* gives examples of the data required to show the feature 91 in the form of the length of the vector V as a function of the angle alpha, expressed in radians. E.g., at an angle 0.295 radians, the vector V is equal to 4.93, as the table shows. The table in FIG. 11*a* indicates 64 positions of the vector V; in other words, 64 points on the perimeter of the feature 91. It follows that the perimeter can be indicated by 64 points. It also follows that a simple procedure for interpolating additional points between aforesaid 64 points can readily be devised, in order to present the feature 91 in the form of an almost continuous line. Additional realism can be introduced by means of a procedure for filling the interior of the feature with symbols to indicate water as shown for the feature 92, or leaves in the feature 93 indicating a tree. FIG. 11*a* also shows the coordinates x1, y1 of the center c in relation to the lower left hand corner of the viewing screen 19. FIG. 10 also shows a feature 94 which may be, for example, a boundary line of a fairway which may be presented by points on the line, each represented by cartesian coordinates x2, yx, which may be contained in the graphic memory catalog module 84 in FIG. 6. Again a simple interpolation may be used by a computer program to add additional coordinates to supply points between those shown in the table 11*b*. Using techniques of this type it is possible to show various features of the golf course with a relatively modest amount of computer memory.

Other features of a golf course may also be stored in the graphic memory catalog 84 of FIG. 6 which may further contain repetitively used symbols, e.g. the flag, the golf cart and so forth.

FIG. 15 shows in more detail the keyboard 24, which consists of ten digit buttons 0–9, two command buttons "HOLE" and "SCORE" which are used to instruct the golf cart computer 12 when a hole is selected or when a score is to be entered.

FIG. 13 shows the connections between the memory cartridge 13 at the left-hand side and the computer at the right-hand side of the figure, which may be either the golf cart computer 12, or the printing station computer 17 which are identical in this respect. The dividing line 33 shows the mating pins of the cartridge and the computer. At the top is shown an eject switch 91 which is physically activated by a stop 92 projecting from the computer side of the receiving slot 18, and serves to close the contacts of the switch 91 which is physically activated by the stop 92, which serves to close the contacts of the switch 91, which in turn extends ground from the cartridge 13 via pin 4 through a 330 ohm resistor to a ground sensing element in the computer (not shown) when the cartridge 13 is completely seated in the receiver 15 or 18 for the golf cart computer or printing station computer, respectively.

In the fully inserted condition ground potential is also extended from the switch 91 via pin *4, to the emitter of transistor Q1. Also, in this condition, +5 is in the computer via pin 14 to the cartridge, looping back in the cartridge to pin 29, via resistor R5 in the computer, via diode D1 back to the base of transistor Q1, which is maintained in its conducting state holding ground potential at the input 1 of the exclusive OR-gate XOR1. Transistor Q3 is maintained in conducting state by simultaneous presence of +5 V at pin 29 and −3 V at pins 33 and 24. The −3 V is supplied by a lithium battery in the cartridge, seen in FIG. 14. If +5 V is not extended into the cartridge from the computer, or the −3 V battery in the cartridge is low, the transistor Q3, having a zener diode Z, having a zener voltage of approximately 2 V will become non-conducting, and the transistor Q1 will also become non-conducting, causing +5 V via resistors R2 and R3 to appear at input 1 of XOR1, and its output will go high, signalling a reset via lead RES to the computer circuit.

Also, when fully inserted, with voltages +5 V and −3 V being present, input 1 of the NAND gate is maintained at ground from the emitter of transistor Q2, maintained in conducting state from +5 V at the collector of transistor Q3, via resistor R7. The output of gate NAND is therefore high, until input 2 of the same gate is also taken high by the I/O select lead from the computer. In that case the NAND output goes low, which enables the output of amplifiers A2 and A3, which allows two PROM ADDR SEL leads from the computer to activate two selected PROM leads at pins 25 and 2 to select two test PROM addresses which return a test pattern to the computer on a PROM OUT lead. The test pattern is stored in the PROM, and when correctly received, indicates to the computer that the RAM memory in the cartridge is ready for reading or writing on the respective read or write leads RD and WR.

When the cartridge is ejected or removed from the receiving slot in either computer, the pins *4, *25 and *2, which are shorter than the other pins, break first to insure that power is removed when the other pins break. In this way damage to the circuits is prevented. Also, on retraction, the switch 91 opens, removing ground from the emitter of transistor Q1, causing pin 1 of gate XOR1 to go high, which causes lead RES to go high, which resets the computer and prevents any attempt to read or write, as long as all conditions for reading or writing are not in working order.

FIG. 14 is a schematic circuit diagram of the memory cartridge 13. Two memory chips, the ROM Z-1 and the RAM Z-2 are shown. These are advantageously of the type 27C256 and 6116 respectively. The two chips receive address leads A0–A10, with the ROM having the additional address leads A11–A14, and the data leads D0–D7. The pins RAM and RES marked with an asterisk are the shortened pin, for leads RAM and RES. The 3 volt lithium battery 93 provides reduced standby voltage to the RAM pin VCC via diode D2, while +5 volts is supplied via diode D1, which joins diode D2 at the cathode. The eject switch 91, connected from ground to pins 1 and 4, are described hereinabove.

In operation the cartridge ROM Z1 is an extension of the ROM 61 in the computer 17, when the cartridge 13 is plugged into the printing station or the ROM 39 when it is plugged into the cart computer 12, and in the latter position, also of the RAM Z-2 (45).

FIG. 16 is a block diagram of the cart computer 12 connected to the memory cartridge 13, showing the plug-in connector 33 for connecting them together, the connector switch 91 connected to the microcomputer 12, serving to protect the data stored in the cartridge upon its insertion into the cart computer 12.

FIG. 17 is a block diagram of the memory cartridge 13, the central computer 17, the connector 33 for connecting them together and the switch 91 for protecting the data stored in the memory cartridge upon insertion into the central computer 17.

We claim:

1. A computer system for use on a golf course comprising:

a) a central computer located in a substantially fixed location on said golf course and accessible to golf players about to play a game of golf or having just finished playing a game of golf on said golf course;

b) a mobile computer coupled to a golf cart, said golf cart used by a golf player while playing a game of golf on said golf course;

c) said central computer including i) a first central processing unit for controlling functions of said central computer, ii) a printer means for printing a golf score on a golf score card for golf players having played a game of golf on said golf course, iii) a first interface for receiving a transferable programmable memory means in which said transferable programmable memory means is pre-programmed with a pictorial data of fairways and greens of holes of said golf course and said pictorial data is represented in vector-graphic form, and is golfer programmed with information including golf scoring and golf score data;

d) said mobile computer including i) a second central processing unit for controlling functions of said mobile computer, ii) a monitor for displaying data stored in said transferable programmable memory means upon request, such data including pre-programmed information concerning the nature and extent of physical characteristics of the fairway and green of each hole of said golf course, iii) a second interface for receiving said transferable programmable memory means, and iiii) a key pad means for programming said transferable programmable memory means with a golf scoring data and a golf score data and for requesting display on said monitor of data programmed into said transferable programmable memory means in which said golf scoring data includes a golf score handicap value of said golf player using said mobile computer and said golf score data includes the number of strokes for a hole made by said golf player playing said game of golf;

e) said mobile computer further includes means for calculating said golf score from said golf scoring data and said golf score data and for storing said golf score in said transferable programmable memory means when said transferable programmable memory means is in said second interface and f) said central computer further includes means for reading said golf score stored in said transferable programmable memory means when said transferable programmable memory means is in said first interface and for printing said golf score on said golf card.

2. The system of claim 1 in which the mobile computer includes a light pen for marking selected locations on the monitor, and the mobile computer includes means for computing and displaying distances between selected features of the golf course including the ball.

* * * * *